United States Patent [19]

Lothmann

[11] 4,077,552

[45] Mar. 7, 1978

[54] SLIDING GATE SPRING LOADING TOGGLE

[75] Inventor: Joseph Lothmann, Langerwehe, Germany

[73] Assignee: United States Steel Corporation, Pittsburgh, Pa.

[21] Appl. No.: 763,186

[22] Filed: Jan. 27, 1977

[51] Int. Cl.[2] ..... B22D 37/00; B22D 41/08

[52] U.S. Cl. ..... 222/600; 222/512; 251/144; 251/193

[58] Field of Search ..... 222/512, 598, 600; 164/337; 251/144, 193, 203, 204

[56] References Cited

U.S. PATENT DOCUMENTS

| | | | |
|---|---|---|---|
| 3,321,174 | 5/1967 | Schertler | 251/204 X |
| 3,779,424 | 12/1973 | Shopland, Jr. | 222/600 |
| 3,937,372 | 2/1976 | Bode, Jr. | 222/600 |

*Primary Examiner*—Stanley H. Tollberg
*Assistant Examiner*—David A. Scherbel
*Attorney, Agent, or Firm*—John F. Carney

[57] ABSTRACT

The toggle levers in a sliding gate valve operative to impart the compressive loading between the slide assembly housing and the teeming vessel are mechanically actuated to their engaged or released positions by the drive motor utilized to operate the slide frame. The toggle levers are attached to connecting rods which are, in turn, connected by a follower rod that extends across the path of travel of the slide frame. The follower rod can be positioned on one side of the slide frame or the other to alternatively engage or release the levers. During normal operation of the valve the follower rod is locked to the housing whereby the slide frame is free to move with respect to the toggle levers.

7 Claims, 4 Drawing Figures

SLIDING GATE SPRING LOADING TOGGLE

BACKGROUND OF THE INVENTION

The present invention relates to a sliding gate valve for a bottom-pour teeming ladle comprising a housing containing a slide frame which mounts a slide plate, the latter being urged against a fixed top plate by springs mounted within the frame. The housing is pivotally attached to the bottom of the ladle by a hinge on one side and a releasable latch on the other side. Compression means are provided on both sides of the housing parallel to the direction of movement of the slide frame by means of which, in cooperation with the aforementioned springs, the housing is urged toward the ladle bottom. A sliding gate valve of the involved type is shown and described in U.S. Pat. Application Ser. No. 377,385, filed July 9, 1973, by E. P. Shapland and J. T. Shapland now abandoned.

Sliding gate valves of the described type employ compression means in the form of toggle levers that pivot about axes parallel to the direction of movement of the slide frame and which, through such pivoting motion, create the preload force upon the springs. Pivoting of the toggle levers is accomplished manually by two actuating rods that engage the levers.

Manual actuation of the toggle levers has several disadvantages. Because the preload forces are generally very great, the actuating rods frequently cannot be simultaneously operated by a single workman, even though the rods may be of extended length. This leads to a situation where the actuating rods must be operated in sequence thus creating the possibility of distorting the housing. Even where two workmen are utilized, each operating the respective rods, a precisely uniform operation of the toggle levers cannot be guaranteed. It is apparent that improper operation of the toggle levers can cause misalignment of the housing and produce severe upsets in the pouring operation.

It is therefore the aim of the present invention to provide an improved sliding gate valve of the described type that permits simultaneous operation of both toggle lever actuating rods and without the use of the manual efforts of workmen whereby the above disadvantages are avoided.

SUMMARY

Accordingly, the present invention provides, in a sliding gate valve of the described type, compression means including toggle levers that pivot in a plane parallel to the direction of movement of the slide frame whereby the levers are caused to be urged into their stressed position by the slide frame, and, conversely, are urged out of their stressed position by action of the slide frame. These actions are effected by a follower device operatively disposed between the slide frame and the levers. The follower device is effective to transmit forces in only one direction and can be locked in place with the toggle levers in their stressed position whereby normal operation of the sliding gate valve can occur.

Stressing and unstressing of the toggle levers by motion of the slide frame is effected by operation of the slide frame drive, usually in the form of a hydraulically operated fluid motor. Thus, the manual efforts of workmen are not required to generate the forces required to preload the springs which produce compression between the slide plate and the top plate. Additionally, effecting the preloading in this manner insures that the toggle levers will be activated simultaneously and uniformly.

A preferred embodiment of the sliding gate valve of the invention employs a follower device including a pair of connecting rods that each connect the toggle levers on each side of the valve housing. The connecting rods are joined by a selectively positionable follower rod disposed transversely to the direction of movement of the slide frame. The follower rod is thus effective to engage either one end or the other of the slide frame and is further operative to be locked with respect to the valve housing when the toggle levers and the assembly are in their stressed condition.

The follower rod, which is of simple design, can be made sufficiently strong to withstand the severe operating conditions to which it is subjected. It has the further advantage of eliminating the possibility of operational errors in that only a single follower rod is employed such that the forces transmitted therethrough between the slide frame and the toggle levers at any given time can occur in only one direction. Additionally, since only one follower rod is employed and it is locked to the housing when the gate valve assembly is in its operative condition, it is totally impossible through workman error for the rod to interfere with movement of the slide frame during the pouring procedure.

It is contemplated to pass the follower rod that joins the connecting rods through openings in the side walls of the housing, which openings are sufficiently sized to permit the follower rod to move in the direction of movement of the connecting rods. The connecting rods, on the other hand, contain vertical slots at the end corresponding to the stressed position of the assembly, which slots are used to guide the follower rod. These slots coincide with slots in the side walls of the housing whereby the follower rod, upon reaching the stressed position, can fall into the slots to be latched thus locking the connecting rods to the housing. This organization has the advantages that the follower rod in its latched position is removed from the path of the slide frame so that, if necessary, the slide frame can be moved beyond the follower rod.

It is further provided by the invention to enable the follwer rod to be inserted into eyes formed in the knees of the toggle levers connecting the ends of the connecting rods that correspond to their unstressed condition. In this way the requirement for additional holes in the connecting rods is avoided.

The toggle levers are preferably pivotally attached at one end to the housing and at their other end are detachably connected to the ladle bottom so that the housing can be swung away from the bottom unimpeded by the levers. Alternatively, the levers could remain attached to the ladle bottom and be detachably connected to the housing. This latter arrangement has the disadvantage, however, that the levers permanently connected to the ladle bottom might interfere with maintenance and repair of the top plate.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 4:
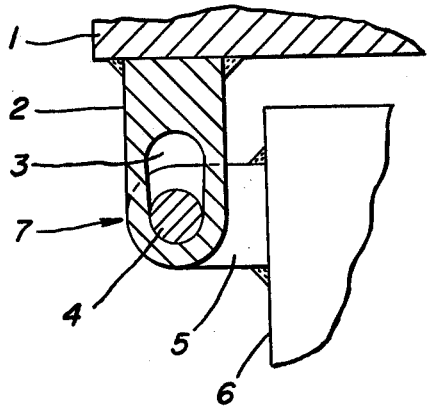
FIG. 4 is a partial sectional view taken along line 4—4 of FIG. 1.

With reference to the drawings, a mounting plate 1, which mounts the gate valve assembly to the bottom of a teeming ladle L carries the clevices 2 containing oblong holes 3 that are elongated, as shown in FIG. 4, perpendicular to the plane of the mounting plate. In the holes 3 of the clevices 2 is located a pin 4 that connects with a housing 6 by means of connector 5. The pin 4 that cooperates with the holes 3 to form a hinge 7 that connects the housing 6 to the mounting plate. The oblong holes 3 permit the housing 6 to be swung away from the mounting plate 1 as well as to move perpendicularly with respect to it.

In the housing 6 is located a slide frame 8 that can slide parallel to the mounting plate 1. The slide frame 8 is caused to move by means of a hydraulically-operated fluid motor, or the like, that includes a cylinder C that attaches the frame by means of ram 9. Movement of the slide frame is in the direction of the double-ended arrow A. The slide frame 8 supports a refractory plate having a depending nozzle termed slide plate 10 that moves with the frame and is held in sealed engagement against a similar refractory plate 11 that is fixed with respect to the mounting plate 1 and housing 6 and termed the top plate. The sealing force between the slide plate 10 and top plate 11 is effected by means of spring biased plungers 12 mounted in the slide frame.

The plungers 12 obtain their loading by the housing 6 being moved by loading devices in the direction of the mounting plate 1. Movement of the housing 6 in that direction is permitted by the oblong holes 3 in the hinge assembly 7.

Figure 1:
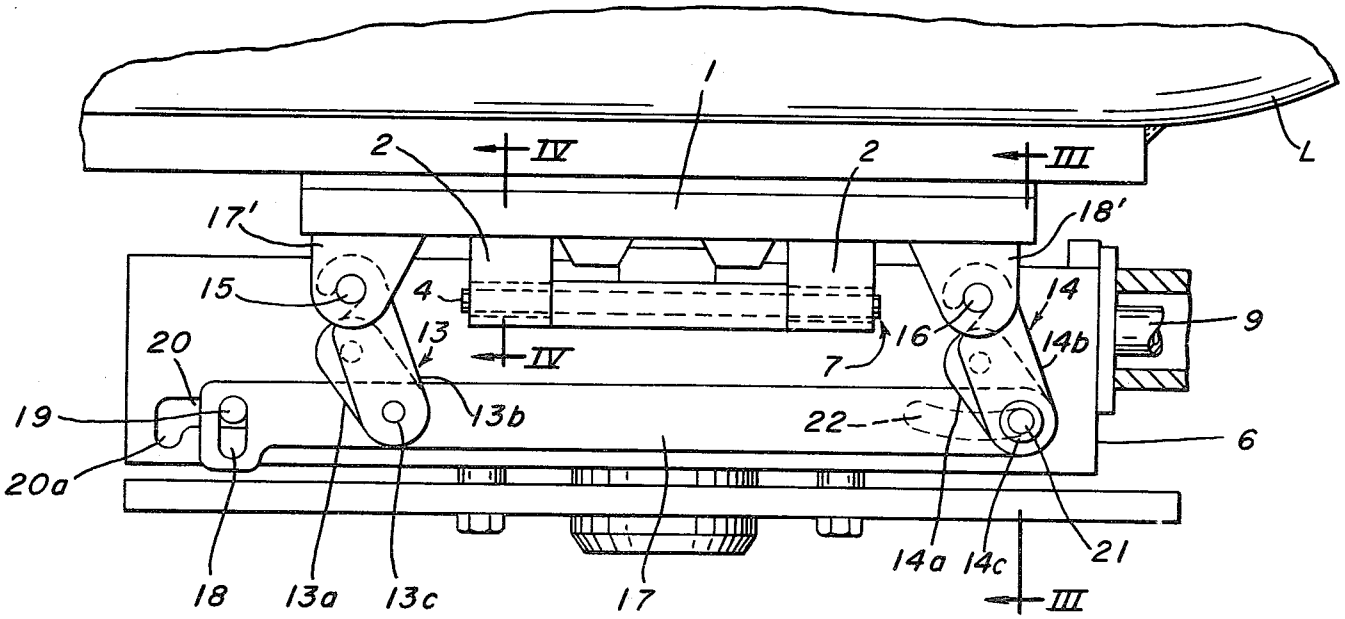
FIG. 1 illustrates a side elevational view of a sliding gate valve constructed according to the present invention.
Figure 2:
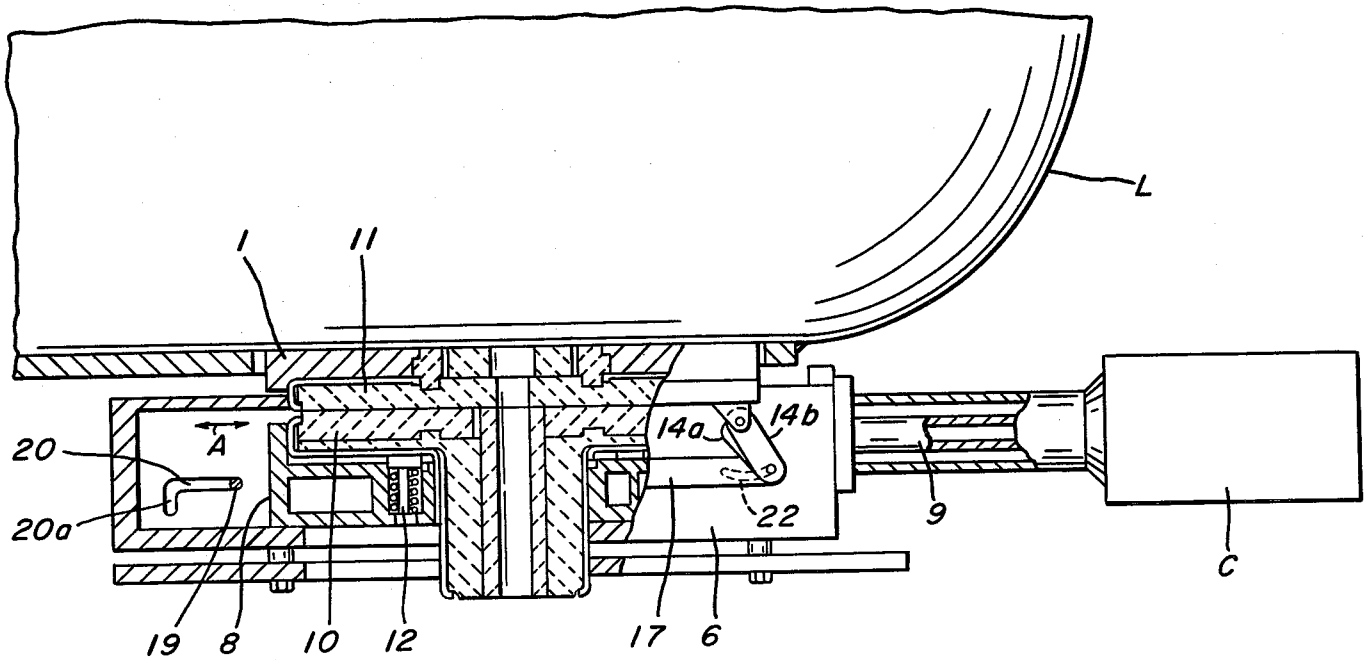
FIG. 2 is an elevational section of the sliding gate valve of FIG. 1.
Figure 3:
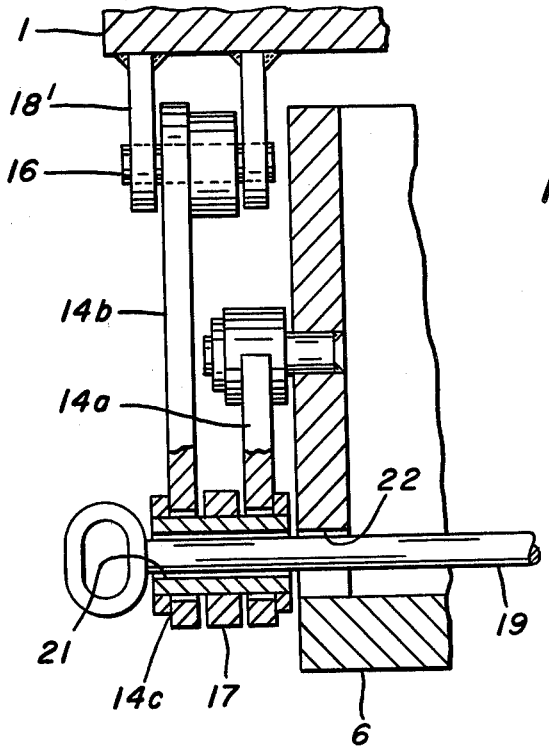
FIG. 3 is a partial sectional view taken along line 3—3 of FIG. 1.

Loading devices, the construction and operation of which are the subjects of the present invention, are located on both sides of the housing 6, only one such device being illustrated in FIG. 1 of the drawing. Each loading device contains two articulated toggle levers 13 and 14, each having one arm **13*a* or 14*a* pivoted at the housing 6, and the other arm 13*b* or 14*b* being suspended from the pins 15 and 16. The pins 15 and 16 are attached to the mounting plate 1 by brackets 17' and 18'. The lever arms 13*b* and 14*b* are suspended by hooks on their ends from pins 15 and 16 so that the levers can be easily disengaged for removal of the housing 6 from the mounting plate 1, and can be easily engaged for pressing the housing 6 against the mounting plate 1**.

The knee joints **13*c* and 14*c* of the toggle levers 13 and 14 in each loading device are connected by a connecting rod 17, disposed parallel to the adjacent side wall of the housing 6 in such a manner that the levers 13 and 14** are caused to move in unison.

At the forward end of each connecting rod 17, i.e., that end shown at the left in FIG. 1, which corresponds to the position the rod is in when the toggle levers are in their stressed position, there is provided an oblong hole 18. A follower rod 19 is inserted into the oblong holes 18 of the two connecting rods 17, passing through horizontally elongated openings 20 in the opposite side walls of the housing 6 and extending across the path of travel of the slide frame 8 therewithin. The openings 20 are sized so that the follower rod 19 has sufficient freedom of movement in the direction of movement of the connecting rods 17. In extending across the path of travel of the slide frame 8 the follower rod 19 is caused to abut the left end surface 21 of the slide frame 8 such that the connecting rods 17 are caused to follow the movement of the slide frame. Movement of the slide frame 8 in the opposite direction, i.e., toward the right in FIG. 1, is not transmitted to the follower rod 19.

Each of the horizontal openings 20 in the side walls of the housing 6 contain at their forward end a vertical slot **20*a*, the shape of which coincides substantially with the lower portion of the oblong hole 18. During movement of the connecting rods 17 forwardly the slot 20*a* is aligned with the oblong holes 18 so that the follower rod 19 will drop into the slot thereby locking the connecting rods 17 in this position with respect to the side walls of the housing 6. With the connecting rods 17 being in this position, it will be appreciated that the toggle levers 13 and 14 of each loading device are near their lower dead center disposition, and the housing 6 is thus at its extreme stressed position with respect to the mounting plate 1**.

The follower rod 19 remains locked in the aforesaid position with respect to the housing 5 during the pouring procedure. With the follower rod 19 so locked, the slide frame 8 carrying the slide plate 10 is free to move within the housing without causing movement of the connecting rods 17 and their associated toggle levers 13 and 14.

Should it be required at the end of the pouring procedure to open the slide gate for the purpose of, for example, replacing the slide plate 10, the top plate 11 or any other component of the assembly, the follower rod 19 is removed from its locking position in the slots **20*a* and inserted instead into holes 21 formed in the knee joints 14*c* in the toggle levers at the rearward end of the valve. Appropriately formed curved openings 22 are formed in the opposite side walls of the housing 6, the curvature of which corresponds to the path of travel of the knee joints 14*c*. These curved openings 22 receive the follower rod 19 such that the same is caused to lie across the path of travel of the slide frame 8. When the slide frame 8 is moved by the ram 9 rearwardly, the rear end surface 23 of the slide frame engages the follower rod 19 moving it and, concomitantly, the connecting rods 17 together with the attached toggle levers 13 and 14, to the right, thereby moving both loading devices simultaneously to their unstress position. The curved openings 22 in the housing side walls are sufficiently large to permit the follower rod 19 to follow the movement of the lever knee joints 14*c***.

With the assembly in its unstressed position, the hooks on the lever arms **13*b* and 14*b* can be disengaged from the pins 15 and 16 and the housing 6 can be swung about the hinge assembly 7 away from the mounting plate 1**.

When it is again desired to close and stress the assembly back into its operative position, the above steps are followed in reverse order. Namely, the housing 6 is attached to the mouting plate 1 by engagement of the hooks on lever arms **13*b* and 14*b* to the pins 15 and 16. The follower rod 19 is removed from the holes 21 in the knee joints 14*c* and is inserted through the oblong holes 18 in connecting rods 17 and the openings 20 in the housing side walls. The slide frame 8 is moved forwardly by the fluid motor until the toggle levers 13** and 14 reach their stressed position and the follower rod is caused to drop into the slots 20*a*.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A sliding gate valve for a teeming ladle including a housing hingedly attached to the bottom of said ladle and vertically movable with respect thereto, a slide frame in said housing, means for imparting motion to said slide frame in said housing a slide plate mounted in said slide frame and urgeable against a superposed top plate by springs carried by said slide frame, and compression means on both sides of said housing parallel to the direction of movement of said slide frame operative to move said housing toward the bottom of said ladle by loading said springs, characterized in that said compression means comprises:

a. levers pivotable in the direction of movement of said slide frame through movement of said slide frame in one direction into a condition loading said springs and into a condition unloading said springs by movement of said slide frame in the other direction;

b. follower means selectively positionable between said slide frame and said levers for transmitting the motion-imparting force from said slide frame to said levers alternately in one direction or the other; and c. means for locking said follower means with respect to said housing when said levers are in the springloading condition.

2. Apparatus according to claim 1 in which said follower means includes:

a. connecting rods connecting the levers on both sides of said housing; and b. a detachable follower rod disposed transversely of the path of travel of said slide frame and positionable alternately on one end or the other of said slide frame.

3. Apparatus according to claim 2 in which said locking means comprises slot means in said housing and said connecting rods, said slot means being mutually alignable when said levers are in their spring loading position for reception of said follower rod.

4. Apparatus according to claim 2 including openings in said housing for reception of said follower rod, said openings being elongated in the direction of movement of said connecting rods to accommodate movement of said follower rod.

5. Apparatus according to claim 4 in which said slot means include vertically elongated slots communicating with the forward ends of said openings in said housing similarly formed slots disposed in the forward ends of said connecting rods.

6. Apparatus according to claim 2 wherein said levers are toggle levers comprising articulated arms connected by a knee joint and wherein the toggle levers adjacent the rearward end of said housing contain openings therethrough for reception of said follower rod.

7. Apparatus according to claim 1 wherein said levers are pivotally attached at one end to said housing and containing hooks at the other end for detachable connection with respect to said ladle bottom.

* * * * *